US005510969A

United States Patent [19]

Rodger et al.

[11] Patent Number: 5,510,969

[45] Date of Patent: Apr. 23, 1996

[54] LUMINAIRE

[76] Inventors: Christopher E. Rodger, 22 Chamberfield Road, Dunfermline, Fire, Scotland, KY12 ODN; Douglas P. Hunter, 13 Den Street, Denbeath, Buckhaven, Fire, Scotland

[21] Appl. No.: 977,278

[22] Filed: Nov. 16, 1992

[30] Foreign Application Priority Data

Mar. 31, 1992 [GB] United Kingdom ..... 9207048

[51] Int. Cl.[6] ..... F21V 11/10; F21V 17/02

[52] U.S. Cl. ..... 362/321; 362/281; 362/283

[58] Field of Search ..... 362/280, 281, 362/282, 283, 319, 321, 323, 322

[56] References Cited

U.S. PATENT DOCUMENTS 3,307,028 2/1967 Bentham ..... 362/281

4,208,100 6/1980 Bischl ..... 362/281

4,210,955 7/1980 Labrum ..... 362/321

4,468,720 8/1984 Arai ..... 362/281

*Primary Examiner*—Denise L. Gromada

*Assistant Examiner*—Y. Quach

*Attorney, Agent, or Firm*—J. E. Brunton

[57] ABSTRACT

A luminaire assembly has a housing including a number of circumferential slots in which the handles of shutter blades are arranged to be slidable. The edges of adjacent slots are radially overlapped around the circumference of the luminaire housing so that each handle may be manipulated over an angular range approaching or exceeding 360/n, where n is the number of slots and/or shutter blades.

18 Claims, 7 Drawing Sheets

(b) (a)

LUMINAIRE

BACKGROUND OF THE INVENTION

1. Field of the Invention

This invention relates to a gate and shutter assembly for use in a luminaire, in other words a lamp unit, particularly, but not exclusively, for application in theatre, studio or other entertainment lighting, to provide a shaped spot of light.

2. Description of the Prior Art

In, for example, theatre lighting it is often desired to produce a square or rectangular patch of light so as to give the impression of light through a window, for instance. For this purpose, an aperture (gate) and shutter assembly is provided within the luminaire housing. The gate comprises a plate mounted transverse to the beam from the luminaire having a central aperture. A plurality of shutters (usually at least four) are provided each comprising a blade within the plane of the gate and a handle projecting out from the luminaire housing through a slot. By manipulating the handle for each blade, the operator can swivel the blade angularly through a range defined by the angular extent of the slot in the housing. He can also push the shutter in and out to reduce the amount of light passing through the gate. Commonly, two shutter blades are provided on either side of the gate, through slots disposed on opposite sides of the luminaire housing. The pair of shutters on one side of the gate is oriented at 90° relative to the pair on the other side.

The extent of motion of each shutter blade is therefore dictated by the angular extent, round the luminaire housing, of the slot through which the handle of that shutter blade passes. Each slot must, of course, extend from the central cavity of the luminaire right through to the outside of the housing where it can be manipulated by a human operator. However, a luminaire is a heavy item of equipment, and one that is often moved from one place to another. It is therefore necessary for the luminaire housing to be relatively strongly built. The portion of the luminaire housing lying behind the gate and shutter assembly comprises the light source, associated electrical components and the ellipsoidal reflector directing light forwardly from the light source. The portion of the luminaire housing forward of the gate and shutter assembly contains imaging lenses, which produce a beam focussed from the plane of the gate, so that the shape formed by the shutters is the shape in cross-section of the beam projected on the stage.

There are thus heavy components at either side of the gate and the shutter assembly, and linking the two are the material within the lands between the slots. In order to provide sufficient structural strength to the luminaire housing, it has hitherto been necessary to provide relatively thick lands between the slots, and this has dictated the maximum angular extent of the slots.

Unfortunately, this has placed a constraint on the freedom of the user to align the shutter blades, and in particular the constraint that it has not been possible to manipulate a given blade through an angle approaching ±360°/2n, where n is the total number of shutter blades. Thus, in a four shutter arrangement it has not been possible to manipulate adjacent shutters (normally inclined at 90° neutrally) to a blade inclination of 180° (i.e parallel blades). This constraint limits the freedom of the lighting designer.

One solution previously adopted is to employ "off-set shutters"—that is, shutters in which the handle is not mounted in the centre of the shutter blade but is off-set to one side or at an angle to the blade. Such shutters are removable through the slots in the luminaire housing. In use, the operator can achieve a wider range of shutter angles by taking the shutter out, turning it over and re-inserting the other way round. However, there are several problems with this solution. Firstly, it is harder to use for an operator since a given handle position corresponds to two different shutter inclinations, depending on which way round the shutter is. Secondly, the shutter blades are, in use, subjected to intense heat so that they become red hot and warp. It is therefore difficult to remove and re-insert the shutters whilst the luminaire is in use or after the blades have become permanently distorted.

SUMMARY OF THE INVENTION

Accordingly, in one aspect the invention provides a housing in which the gate plate acts as a load bearing member, so that the lands between slots can be eliminated and the slots can overlap.

In another aspect, the invention provides a luminaire assembly in which the gate plate is formed as an integral whole with the housing; this enables the gate plate to be simply made to act as a load bearing member.

In a further aspect, the invention provides a method of manufacturing a luminaire assembly comprising forming the gate plate as an integral whole with at least a portion of the luminaire assembly.

In a further aspect, the invention provides a luminaire comprising a housing, a gate, and a plurality of slots extending circumferentially around the housing, in which the angular positions of the ends of the slots around the housing overlap.

In another aspect, the invention provides a luminaire comprising a light source, housing and a plurality of shutters in which each of the n-shutters can be angularly rotated through an angle approaching, 360°/n.

In known luminaires, as noted above, the shutter blades become hot and warp. The warping often takes the form of an expansion of the central portion of the shutter blade (which is the portion which lies within the beam most often) and consequently the edges of the shutter blade tend to curl. For many shapes of shutter blade, it is therefore possible for an edge of the shutter to become jammed through the central aperture of the gate plate in use, which may require the luminaire to be disassembled and is consequently very undesirable where the luminaire is used in live entertainment or studio work, for example.

Accordingly, in a further aspect of the invention there is provided a shutter blade which includes edge retention features, disposed towards the ends of the shutter blade, for cooperation with guide features on a luminaire assembly. The edge retention features may comprise raised tabs, for example. Likewise provided is a luminaire assembly including, within the gate assembly, guide features for cooperation with the edge retention features of each shutter blade, disposed in a ring so as to prevent the corners of the shutter blade entering the central aperture of the gate plate over the whole range of shutter blade orientations.

The guide features may comprise a raised lip on a spring plate pressing the shutter blade against the gate plate, for example. Equally, the guide means could be disposed on the gate plate.

A further problem with prior arrangements of the gate assembly has been that the assembly involves a large number of separate components requiring a large number of separate fixing means, biasing springs etc. This makes it difficult and time consuming to strip down the luminaire assembly to replace components. In particular, a prior art construction has provided pressure plates which are resiliently biased to urge the shutter blades against the gate plate; often, a separate set of biasing leaf springs are provided to bias the whole gate assembly together.

In a further embodiment of the invention, we provide a luminaire assembly comprising a housing including plurality of circumferential slots through which shutter blade handles pass, further comprising at least one spring plate comprising a plate resiliently urging the shutter blades towards a gate plane, in which the spring plates are insertable through the slots. Preferably, the plates act against the edge of the slots. By providing that the spring plates are insertable through the slots, it is possible to disassemble the shutter assembly without opening the housing.

Since, in the above constructions, the slots may be of considerable width, it would normally be possible to withdraw the shutter blades through the slots. It is generally undesirable that the shutter blades should be accidentally withdrawn in use, both for safety reasons and because reinsertion of the blade can be difficult. Accordingly, the preferred embodiment of any of the above aspects of the invention provides latching means on the shutter blade for engaging a cooperating arcuate latching feature on the gate assembly, so as to retain the shutter within the gate assembly in use.

Other aspects and preferred embodiments of the invention will be apparent from the following description of drawings or claims.

BRIEF DESCRIPTION OF THE DRAWINGS

The invention will now be illustrated, by way of example only, with reference to the accompanying drawings in which.

DESCRIPTION OF PREFERRED EMBODIMENTS

Figure 1:
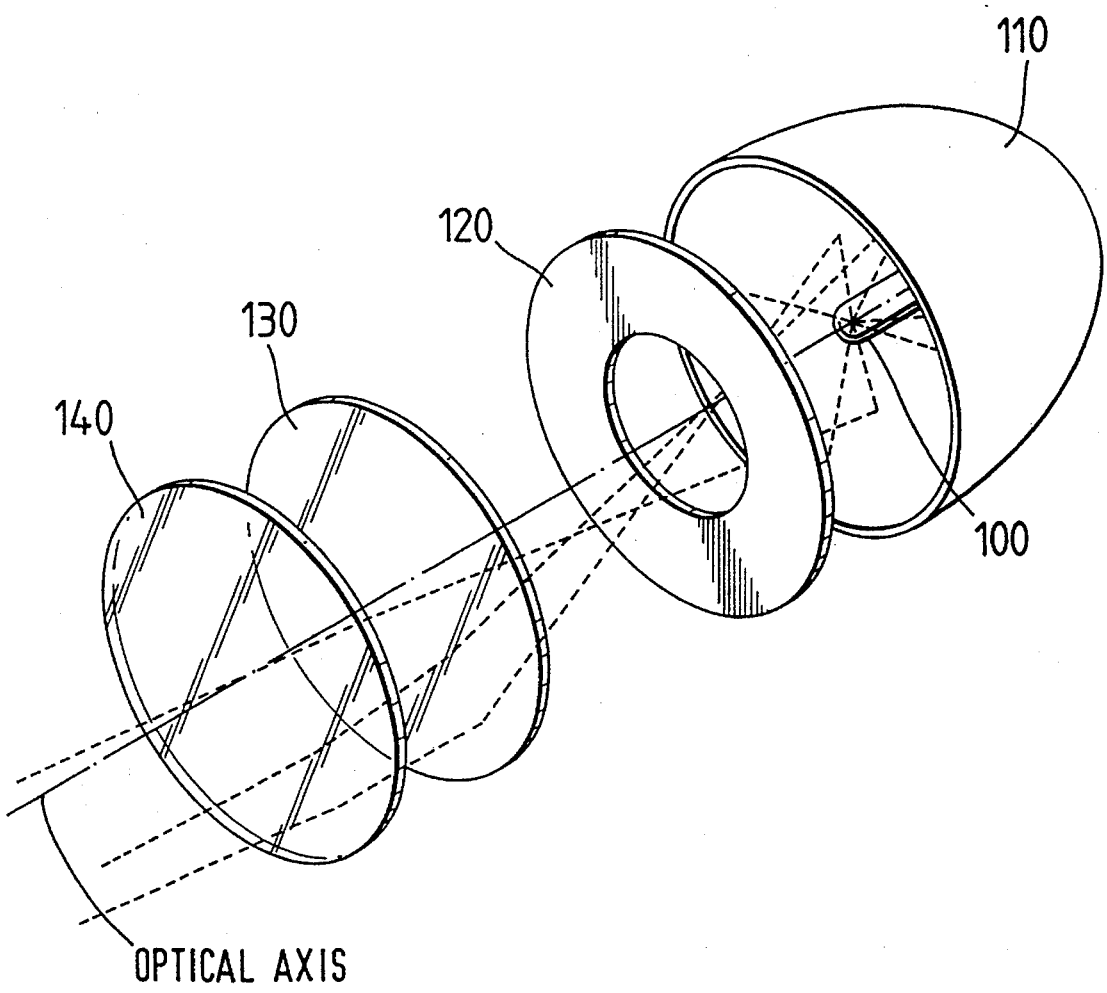
FIG. 1 shows schematically the optical structure of a luminaire assembly including a gate.

Referring to FIG. 1, the optical components of a luminaire for stage, studio or other entertainment use comprise a light source 100 (typically a 500 W–5 Kw incandescent lamp) located at one focus of an ellipsoidal reflector 110. Light from the light source 100 and reflector 110 is projected forwardly through a central circular aperture in a gate plate 120. The gate plate is positioned so that substantially all the beam passes through the central aperture. A projection lens system 130,140 collects the light passing through the gate plate 120 and provides a generally focussed beam, with the edges of the aperture of the gate plate approximately in focus on the stage. The components 100–140 are housed within a luminaire housing (not shown) and the shutter blades are provided adjacent the gate plate 120.

The mounting of the luminaire 100 may be as described in our UK patent application no. 9207085.3 filed on Mar. 31, 1992 (agents ref 3251701) incorporated herein by reference.

Figure 2:
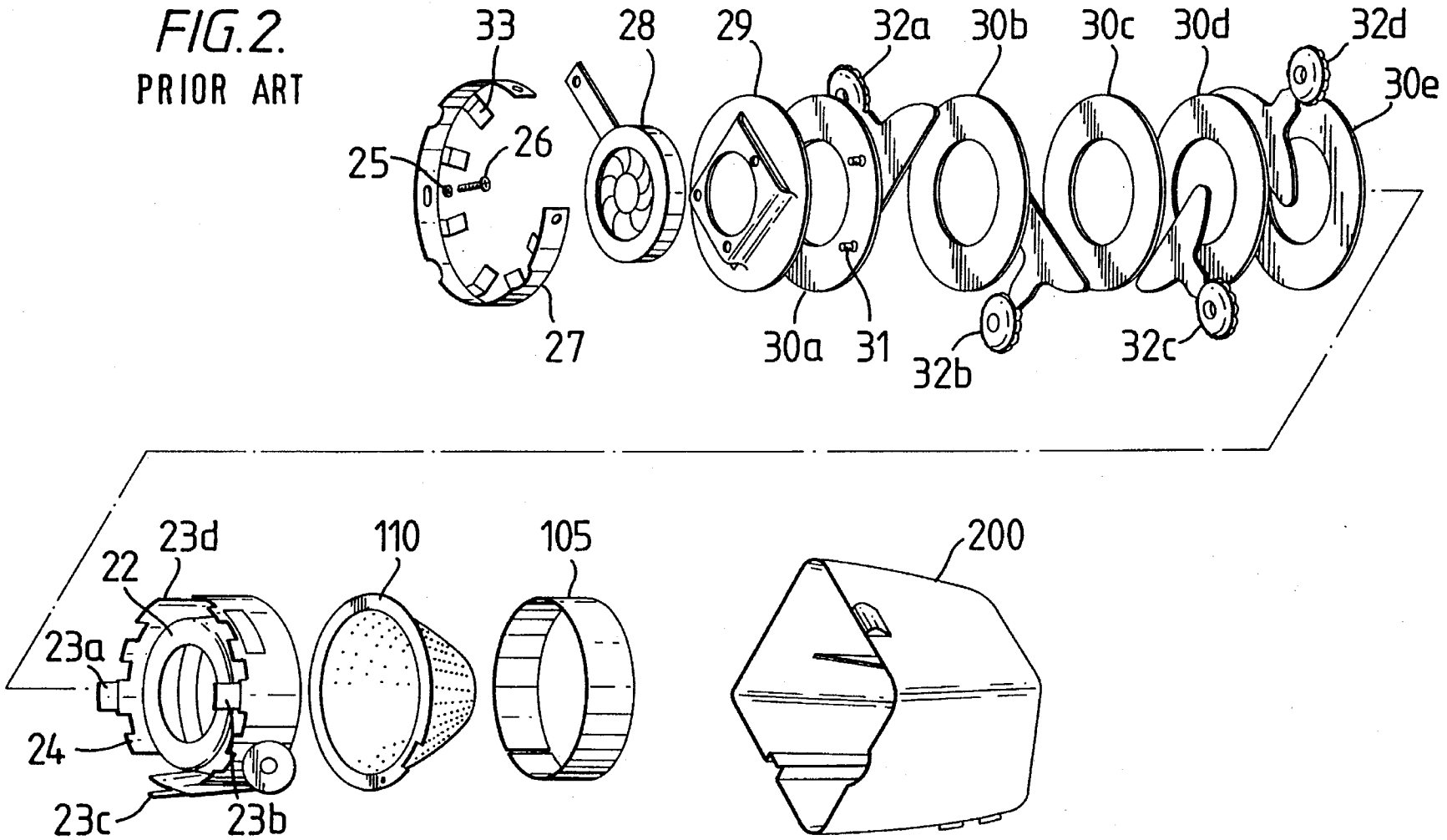
FIG. 2. PRIOR ART
FIG. 2 shows schematically a prior art arrangement of gate assembly.

Referring to FIG. 2, in one particular known structure (employed in the Strand Lekolite [registered trade mark] spotlight available from Strand Lighting Ltd, the present applicants) a rear luminaire housing portion 200 receives the reflector 110 surrounded by a heat 105. The gate assembly comprises a rear mounting collar 24 secured to the rear luminaire housing portion 200, and carrying four mounting posts **23*a*,23*b*,23*c*,23*d*. To these a forward luminaire housing portion (not shown in FIG. 2) is secured by screws, to mount the projection lenses 130,140 shown in FIG. 1**.

Within the mounting collar 24 is provided an inner ring plate 22 which receives five separator plate **30*a*–30*e* between which are sandwiched four shutter blades 32*a*–32*d*, their handles projecting between the mounting posts 23*a*–23*d* which define four slots by virtue of the separation between the rear luminaire housing portion 200 and the forward luminaire housing portion. Optionally provided adjacent the shutter assembly is an iris 28, located against an upper pressure plate 29, and the upper pressure plate 29 is urged against the separator plates by a collar 27 carrying a plurality of leaf springs 33 and secured to the lower inner ring plate 22 by a screw fitting 25,26**.

Figure 3:
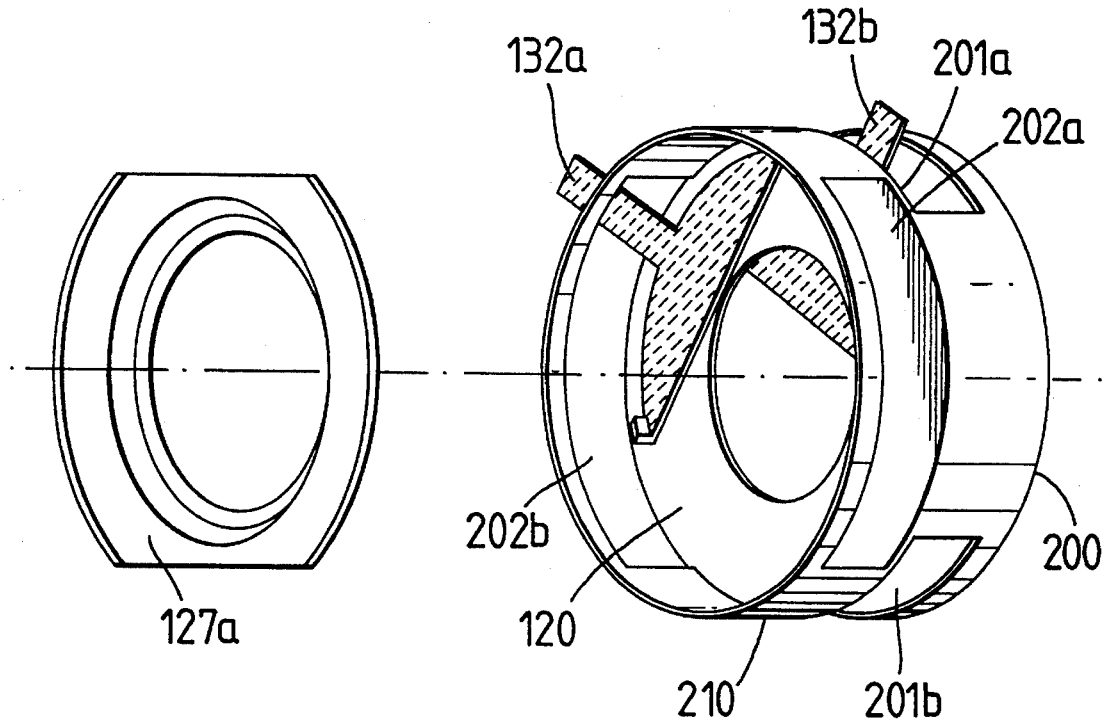
FIG. 3 shows schematically the components of a gate assembly according to an embodiment of the invention.

Referring to FIG. 3, in an embodiment of the invention the luminaire housing comprises a rearward portion 200 and a forward portion 210; although not shown, the rearward portion 200 includes the reflector 110 and bulb or lamp 100 as in FIG. 2, and the forward portion 210 extends forwardly to include the lenses 130,140 shown in FIG. 1. The rearward portion 200 includes two circumferential slots **201*a*,201*b*, and the forward portion 210 includes likewise a pair of slots 202*a*,202*b*. Each slot extends over an angle of greater than 360°/4 (where 4 is the number of slots), so that no lands exist between the slots. The structural connection between the rear portion 200 and the forward portion 210 is provided through the gate plate 120, in other words, the forward and rear halves 200, 210 are only mechanically interconnected through the gate plate 120. In a preferred embodiment, the luminaire housing 200, 210 and gate plate 120 are formed in a single casting operation, with an inner core and two outer moulds. However, gate plate 120 could equally be welded to the rear portion 200 and forward portion 210 or any other method of providing an integral whole could be adopted. The gate plate 120 is therefore of sufficient thickness to provide a reliable structural connection between the two halves 200,210** of the luminaire housing.

The housing/gate plate assembly may conveniently be formed from aluminium; suitable aluminium die casting techniques are well known.

Into each slot **201*a*, 201*b*, 202*a*–202*b* a shutter plate is insertable, as shown. The shutter plate 132*a*,132*b* is generally similar to the construction employed in the prior art; that is, it has a handle portion projecting through the slot for manipulation by the operator, and a straight edged blade portion transverse to the axis of the handle portion. In the embodiment shown, the slots 202*a*–202*b* are sufficiently wide that the blades 132*a*,132*b*** etc can be inserted and withdrawn through the slots; this is generally not possible with currently available luminaire constructions.

Referring to FIG. 3*a* in embodiments where the slots 201, 202 are provided in opposed pairs, the shutter blades 132*a* etc are maintained flat within the plane of the gate plate 120 by providing, for each pair of slots, a pressure plate 127 acting as a spring urging the blades and gate plate together; the pressure plates 127*a*,127*b* (not shown) therefore fulfill the general function of the collar 27 of FIG. 2. Each plate 127 is arranged to be insertable through a respective slot to engage the slot on the opposite side of the luminaire housing (as shown, the plate 127*a* is insertable through slot 202*b* so as in use to engage the edges of the slots 202*b* and 202*a*) and to exert resilient pressure between the edges of those slots and the shutter blades 132 inserted through those slots.

Figure 4:
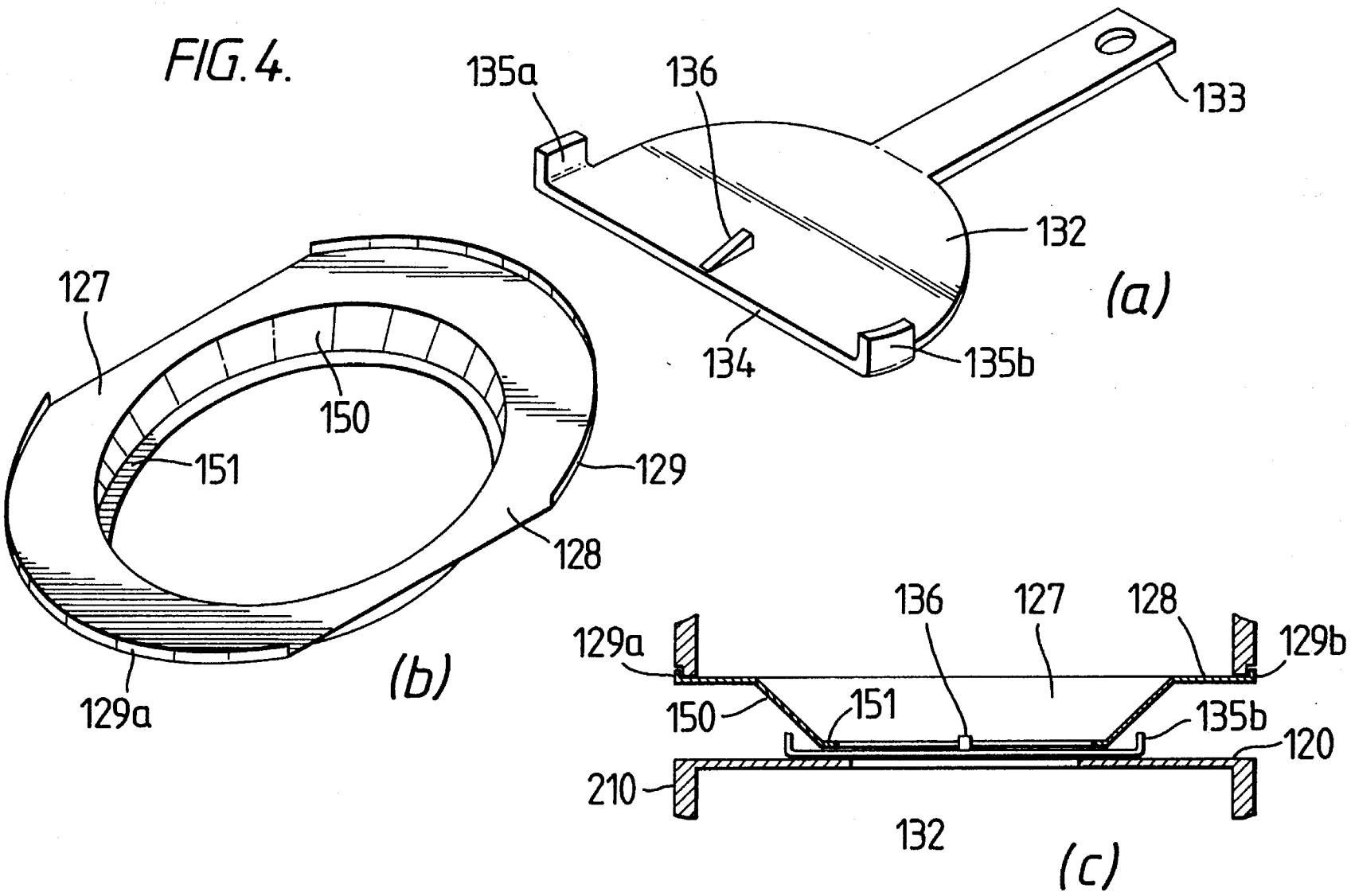
FIG. 4 shows in greater detail the components of a gate assembly according to a preferred embodiment of the invention.

Referring to FIG. 4, the assembly of FIG. 3 is shown in greater detail. A shutter blade 132 comprises a handle portion 133 which is elongate and extends backwardly generally transverse to the straight shutter edge 134 (although the handle 133 could be inclined, it is preferred for ease of operation to provide the handle portion 133 normal to the blade 134). The land between the edge 134 and handle portion 133 is sufficiently broad that when the blade 134 is extended in normal use into the centre of the aperture within the gate plate 120, the rear edge of the land is not visible within the central orifice; some degree of curvature of the trailing edge is also preferred to reduce friction on the inner surface of the luminaire assembly. In other respects, the shape of the land is not critical.

According to this embodiment, a pair of edge retaining features 135*a*,135*b* are provided which prevent the edges of the shutter blade 134 projecting through the central orifice in the gate plate 120. As shown the edge retaining features 135*a*,135*b* are conveniently provided as upturned tabs at the edge of the shutter plate 132.

In this embodiment, since the shutter plate 132 is of narrower overall width than the width of the slot 202 through which it is inserted, a blade retention feature is provided on the plate 132; the blade retention feature 136 conveniently comprises a barb sloping backwardly towards the handle portion 133, so as to allow the shutter blade to be readily inserted but not removed.

The shutter blade 132 is conveniently provided as a stainless steel pressing, and the barb 136 as a semi-pierce on the pressing.

Referring to FIG. 4B, the spring plate 127 comprises an upper land 128 in the form of a generally ring shaped flat sheet, of outer diameter corresponding to that of the luminaire housing 210; the opposed sides of the ring 128 are truncated so as to limit the width of the plate 128 to be smaller than that of the slots 202 so that the plate 127 is insertable through the slots. The upper land 128 bears against the edges of the slots 202 in use.

A pair of upturned rims 129*a*,129*b* are provided at either end of the plate 127, to engage the edges of the slots 202 on the outside of the luminaire housing 210 and laterally retain the plate 127 within the housing in use.

Continuous with the inner edge of the ring 128 is a frustoconical surface 150 at the lower edge of which is an inner annular ring 151 of inner diameter equal to or greater than the central aperture within the gate plate 120, so as not to obtrude into the central aperture of the gate plate. Splits (not shown) in the edges of the inner ring 151 and for 127 and 150 may be provided to localise the pressure exerted on the shutter blades 132 so that distortion of one shutter blade does not affect the retention of the other.

Conveniently, the pressure plate is formed as a stainless steel pressing.

Referring to FIG. 4C, the arrangement in use of the components of FIGS. 3 and 4 is shown. The pressure plate 127 shows, in cross-section, a lazy-Z shape providing a spring force between the upper land or ring 128 and the inner ring 151; since the upper ring 128 bears against the forward part of the luminaire housing at the forward edge of the slots 202, the inner ring 151 is urged towards the shutter blade 135 and gate plate 120, biassing the two together. The frustoconical portion 150 has a height corresponding generally to the height of the slot 202, and thus prevents light loss through the slots 202.

It will be seen that the pressure plate 127 exerts a resilient force which not only retains the shutter blade 132 within the luminaire housing, but also retains the pressure plate 127 itself, by virtue of the rims 129. This will be seen to greatly reduce the complexity of the assembly, as compared with the prior art for, for example, FIG. 2, enabling this embodiment to operate entirely without screws or bolts, which thus greatly reduces the complexity of assembly and disassembly of the luminaire.

Typically, the number of components to be disassembled is reduced from 10 to three and the need for screwdrivers or other tools is greatly reduced with consequent reduction in the time for which the luminaire is inactive whilst the blade and pressure plate is replaced.

The assembly of the gate and shutters is as follows. Firstly, the pressure plate 127 is inserted through a first slot 202*b* until the rim 129*b* engages the outer surface of the luminaire housing 210 (forward portion); as shown, a recessed ring may be provided at the forward edge of the slot 202*a* to accommodate the rim 129*b*. Then a shutter blade 132 is inserted through a slot 202*b*, between the gate plate 120 and the inner ring 151, and urged forward so that the barb 136 enters within the inner ring 151, trapping the shutter blade against accidental removal. The next shutter blade 132 is then inserted through the other slot 202*b*. A further spring plate 127*b* (not shown) is likewise inserted through the other pair of slots 201*a*,201*b* with the outer rims 129*a*,129*b* bearing this time against the backwards edges of the slots 201*a*,201*b* and the inner edges 151 towards the shutter plate 120, and a corresponding further pair of shutter blades 132 are inserted between the second pressure plate 127 and the gate plate 120.

To disassemble the components, the shutter plates are withdrawn until the barb 136 locates against the inner rim 151. A convenient tool (for example, a screwdriver) is then used to urge the inner rim 151 away from the shutter blade 132 to the extent necessary to withdraw the barb 136. After the blades 132 are withdrawn it is then possible to remove the pressure plate 127 through one of the slots 202*a* or 202*b*.

It is necessary to replace the shutter blades 132 relatively frequently because of the shape degradation caused by the heating to which they are subjected in use.

Figure 5:
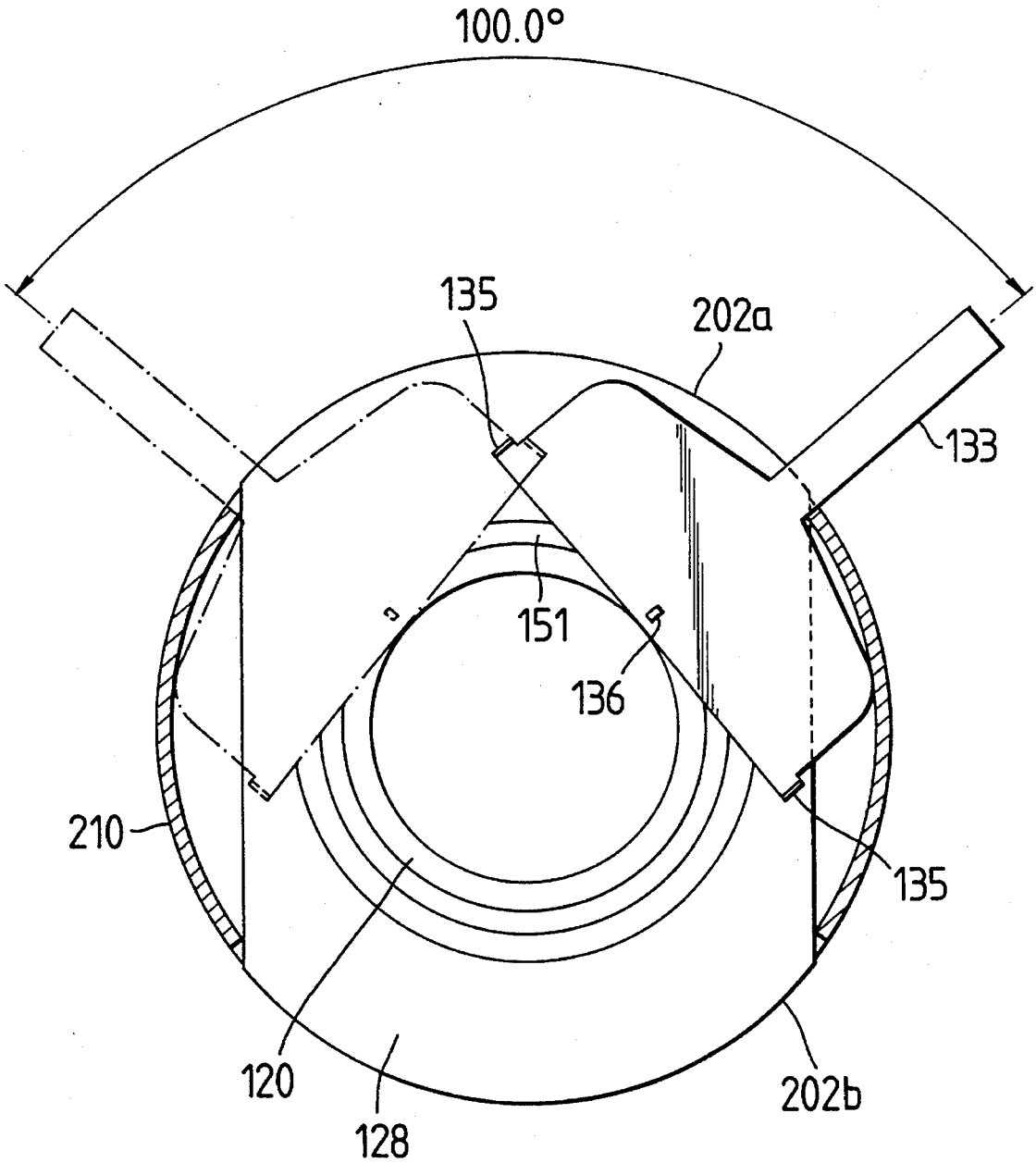
FIG. 5 shows the gate assembly of FIGS. 3 and 4 in use.

Referring to FIG. 5, it will be seen that in use, a blade 132 can be rotated through an angle of 90° (or, in general, 360°/n where n is the number of blades) by manipulation of the handle 133, and that the tabs 135 engage with the shutter plate 127 to prevent the corners of the blade entering within the gate aperture. The edges of a pair of blades through opposed slots 202*a*,202*b* may therefore be brought parallel to one another if desired, or even manipulated further so that the two handle portions 133 define an acute angle, rather than the obtuse angles necessary in the prior art. A much greater range of beam shapes are therefore available to the lighting designer.

By way of example only, the shutter blades and pressure plate may be of stainless steel sheet thickness of SWG24.22 and the luminaire housing and gate plate assembly 210,120 of aluminium alloy thickness 2.0–2.5 mm, die cast. However, any other materials suitable for the mechanical and thermal conditions well known to exist within luminaires could equally be used.

It will be understood that many alternative embodiments and departures from the above construction will be possible to the skilled person. For example, although the above described embodiment provides a simple one piece luminaire assembly the principle of overlapping, radially, the edges of the adjacent slots to provide greater ease of manipulation could be employed even with other types of luminaire housing in which the shutter plate 120 does not bear any mechanical load. Although only four shutter blades and slots have been shown, a greater or lesser number could, of course, be employed. Although the above described embodiment utilises a pair of shutter blades generally in the same plane inserted through opposed slots, more complex arrangements in which each shutter blade is in a separate plane could be provided. Although four shutter blades are shown, other numbers would be possible. Although the invention is described with reference to a luminaire for stage and studio lighting, it could equally be applied in other optical instruments.

The pressure plate 127 is conveniently inserted through the same slots as the shutter blade, but separate slots could be provided if desired for this purpose, or alternative fastenings provided internally within the housing 200.

Figure 6:
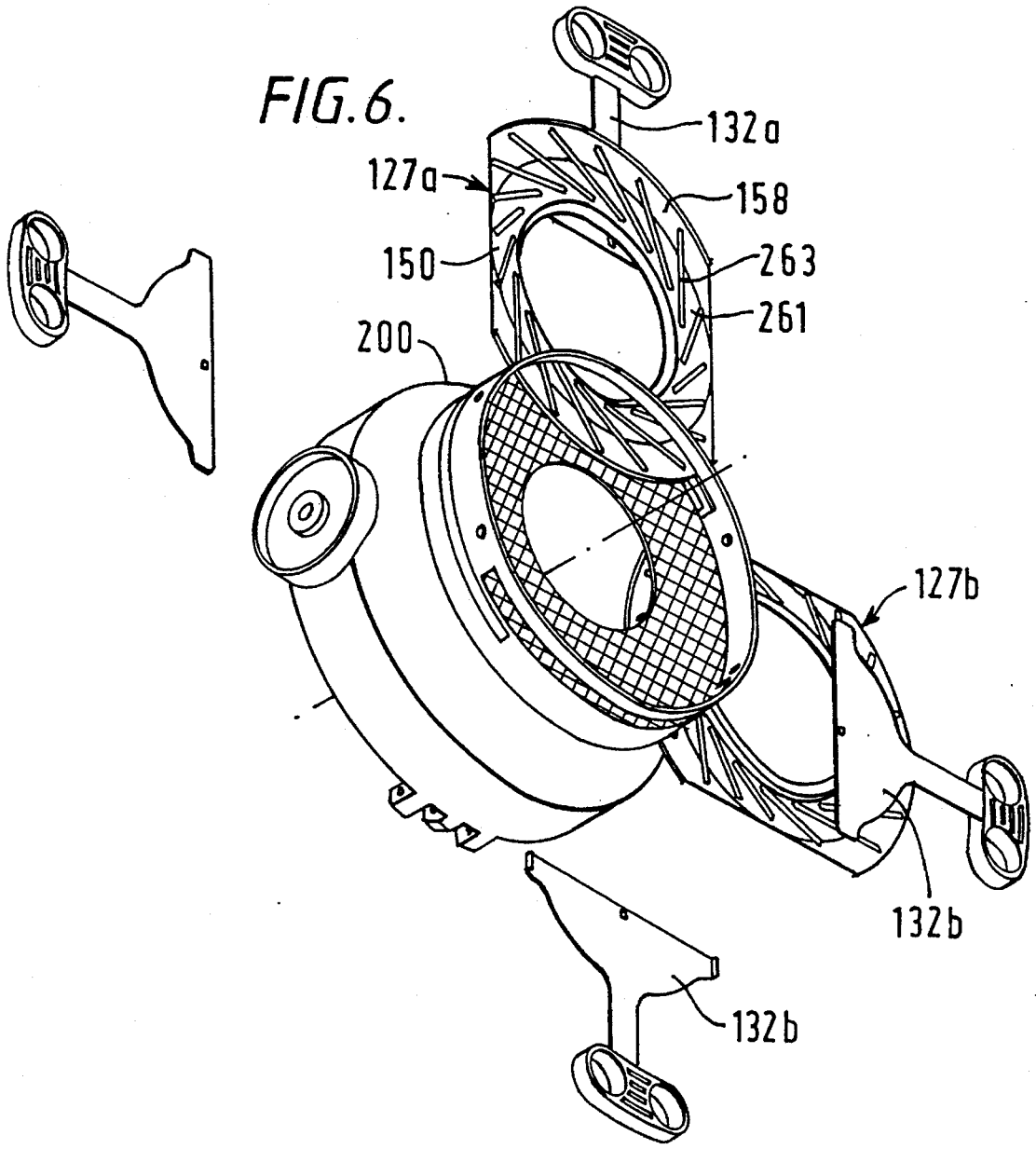
FIG. 6 shows schematically the components of a gate assembly according to an alternative embodiment of the invention.
Figure 7:
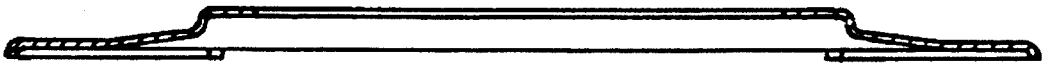
FIG. 7 shows on an enlarged scale a side view of one of the components of the gate assembly of FIG. 6.
Figure 8:
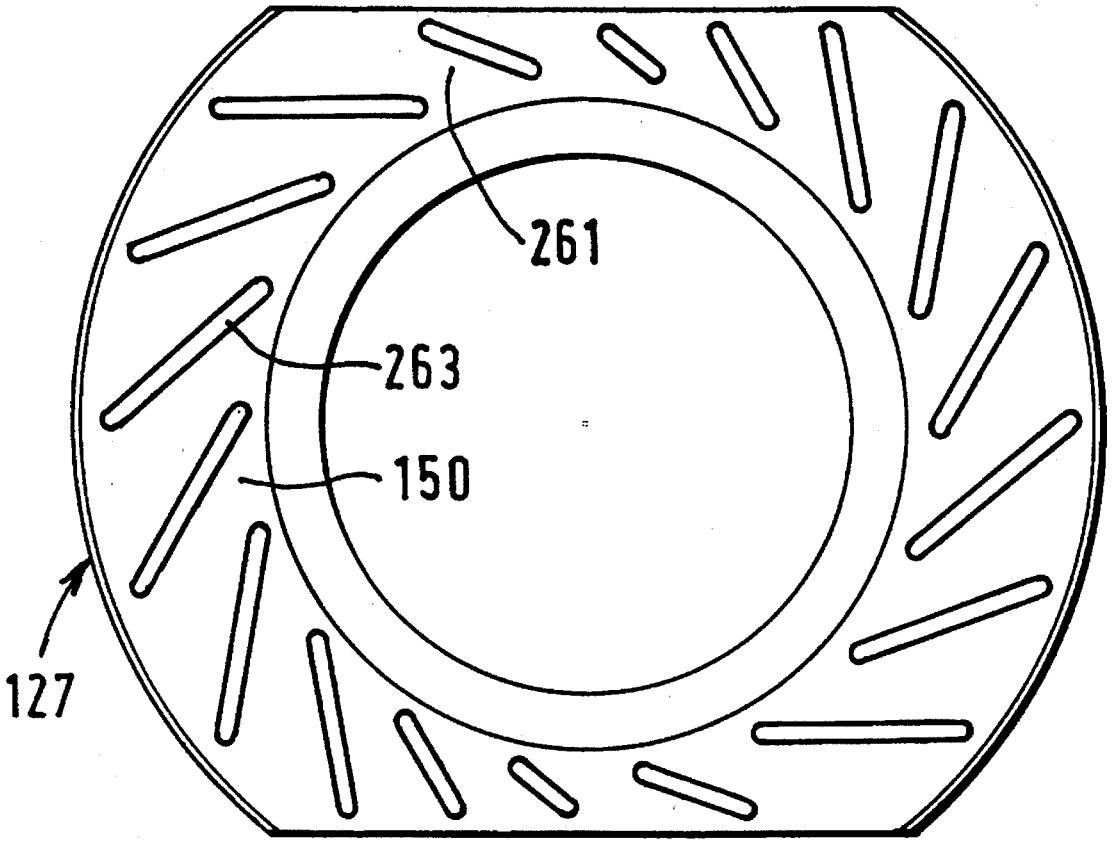
FIG. 8 shows a plan view of the component of FIG. 7.

Turning now to FIGS. 6, 7, 8, in an alternative embodiment each pressure plate 127*a*, 127*b* is provided with a series of slats 261 formed from the frustoconical surface 150 and upper land surfaces 158 by piercing a corresponding series of slots 263. The slats 261 are designed to have differing lengths and are arranged over the plate 127 so as to ensure that there is a substantially even spring pressure over the contact surfaces, avoiding the problem of tight or loose spots. Furthermore, the corresponding slots 263 enable better ventilation of the housing 200.

What we claim is:

1. A luminaire housing in which is defined a number of circumferential slots, in which the handles of shutter blades are arranged to be slidable, the edges of adjacent slots being radially overlapped around the circumference of the luminaire housing so that each handle may be manipulated over an angular range approaching 360°/n, where n is the number of shutter blades.

2. A luminaire housing according to claim 1 in which the slots are disposed in opposed pairs of facing slots sharing a common plane.

3. A luminaire housing according to claim 1 in which the slots are sufficiently wide as to permit the insertion of a pressure plate acting on the shutter blades therethrough.

4. A luminaire housing according to claim 1, a plurality of shutter blades provided with handles extending through the slots therein, and at least one spring member acting on said blades for retaining the blades in a desired plane.

5. A luminaire housing according to claim 4 in which the spring member comprises a resilient element acting between the housing and each shutter blade or blades, the spring member comprising means for engaging the housing such that the resilient element of the spring member retains the spring member within the housing in use, and enabling it to be removed by overcoming its resilience.

6. A luminaire housing according to claim 5 in which the resilient element includes a series of slatted members designed so as to produce an even spring pressure over the regions contacted by the resilient element.

7. A luminaire housing according to claim 4 in which said at least one spring member comprises a first surface engaging a porting of the housing, a second surface engaging at least one shutter blade in use, and an inclined portion connecting the two surfaces.

8. A luminaire housing according to claim 7, in which the portion of housing comprises an edge of a slot provided by the housing.

9. A luminaire assembly according to claim 8, in which the slot is one in which the handle of a shutter blade is adapted to slide.

10. A luminaire housing according to claim 4, in which a gate plate has a central aperture and each shutter blade comprises a blade edge portion at each end of which is disposed an edge retaining feature for preventing the respective edge end from entering the central aperture of said gate plate within the housing.

11. A luminaire housing according to claim 10, in which the retaining feature comprises at least one detent cooperating with a portion of the said at least one spring member.

12. A luminaire housing according to claim 4, in which each shutter blade includes a detent for preventing removal of the shutter blade from the luminaire housing.

13. A luminaire housing according to claim 12 in which the detent comprises a barbed feature for cooperation with a portion of the said at least one spring member within the housing, allowing the shutter blade to be inserted into the luminaire housing but preventing its withdrawal therefrom in use.

14. A luminaire housing according to claim 13, in which said at least one spring member has first and second surfaces and in which said portion of the said at least one spring member with which said barbed feature cooperates comprises said second surface.

15. A luminaire including a housing, a gate plate and a shutter assembly, said gate plate residing in a plane and having a gate aperture therein, and said shutter assembly comprising a plurality of shutter blades connected to said housing to selectively close portions of the aperture, said shutter blades being slidable both radially and circumferentially of said gate aperture, said luminaire further comprising at least one spring member biasing said shutter blades generally into the plane of said gate plate, and in which said housing has a slot into which said at least one spring member is insertable for acting between said housing and said shutter blades, said at least one spring member including a wall portion blocking the egress of light through the slot through which it is insertable, said luminaire further including retaining means for retaining said at least one spring member within said housing.

16. A luminaire according to claim 15 in which said shutter blades include handles and in which said slots through which said spring members are insertable comprise said slots provided for said handles of said shutter blades.

17. A shutter blade for use in a luminaire, having a gate assembly including a gate having a central aperture, said shutter blade residing in a plane and comprising a blade edge portion and a handle portion extending rearwardly therefrom, said blade edge portion, including retaining means for preventing the blade edge portion from projecting through said central aperture of said gate, said retaining means comprising a pair of detents extending out of said plane of said blade.

18. A shutter blade for use in a luminaire having a body and a gate assembly including a gate provided with a central aperture, said shutter blade residing in a plane and comprising a blade edge portion and a handle portion extending rearwardly therefrom, said blade edge portion, including retaining means for preventing the blade edge portion from projecting through said central aperture of said gate, said body of said luminaire including means for cooperating with said retaining means of said blade edge portion.

* * * * *